US009966204B2

(12) United States Patent
McCauley et al.

(10) Patent No.: US 9,966,204 B2
(45) Date of Patent: May 8, 2018

(54) TAPE SWITCH MOUNTING BRACKET FOR FIREARM

(71) Applicants: Sean McCauley, Newburgh, IN (US); Eric Small, Alabaster, AL (US)

(72) Inventors: Sean McCauley, Newburgh, IN (US); Eric Small, Alabaster, AL (US)

( * ) Notice: Subject to any disclaimer, the term of this patent is extended or adjusted under 35 U.S.C. 154(b) by 0 days. days.

(21) Appl. No.: 15/240,507

(22) Filed: Aug. 18, 2016

(65) Prior Publication Data

US 2018/0053607 A1 Feb. 22, 2018

(51) Int. Cl.
*H01H 9/02* (2006.01)
*F41G 11/00* (2006.01)
*F41G 1/34* (2006.01)

(52) U.S. Cl.
CPC ..... *H01H 9/02* (2013.01); *F41G 11/003* (2013.01); *F41G 1/34* (2013.01)

(58) Field of Classification Search
CPC ..... H01H 9/02; F41G 11/003; F41G 1/34
USPC ..... 42/90, 119
See application file for complete search history.

(56) References Cited

U.S. PATENT DOCUMENTS 6,568,118 B1 * 5/2003 Teetzel ..... F41G 1/36 42/105
7,199,315 B1 * 4/2007 Sharrah et al. ..... H01H 3/16 200/61.43
7,243,454 B1 * 7/2007 Cahill ..... F41C 23/12 42/72
7,438,430 B2 * 10/2008 Kim ..... F41G 1/34 362/110
7,845,105 B1 * 12/2010 Cahill ..... F41C 23/16 200/86 R
8,341,866 B1 * 1/2013 Gaddini ..... F41G 11/003 42/71.01
9,784,536 B2 * 10/2017 Boswell ..... F41G 11/00 42/146
2005/0243542 A1 * 11/2005 Kim ..... F41G 1/34 362/110
2007/0235298 A1 * 10/2007 Kim ..... F41G 1/34 200/18
2009/0044439 A1 * 2/2009 Phillips ..... F41C 23/14 42/72
2010/0205795 A1 * 8/2010 Moody et al. ..... F41A 23/08 29/428
2011/0167703 A1 * 7/2011 Deros ..... F41G 11/003 42/90

(Continued)

*Primary Examiner* — John Cooper
(74) *Attorney, Agent, or Firm* — Gary K. Price

(57) ABSTRACT

The present invention relates to tape switch mounting bracket for use with a firearm comprising of a one-piece mounting bracket with at least two (2) parallel opposite first and second ends, a switch slot, a rail attachment feature, at least four (4) apertures; and whereby the switch slot is adapted to receive a tape switch; and whereby the rail attachment feature is adapted to mount to a variety of rail mounting systems. The preferred embodiment includes a tape switch mounting bracket with a switch slot comprising of an indention with at least one rounded rectangular third end and an overhang on said first and second ends and said third end; the section beneath or at an adjacent angle to the switch slot comprises a rail attachment feature to mount the tape switch bracket to a variety of rail mounting systems.

17 Claims, 2 Drawing Sheets

(56) References Cited

U.S. PATENT DOCUMENTS

| | | | | |
|---|---|---|---|---|
| 2012/0055061 | A1* | 3/2012 | Hartley | F41C 23/16 42/84 |
| 2012/0266514 | A1* | 10/2012 | Michal | F41C 23/16 42/90 |
| 2013/0318851 | A1* | 12/2013 | Diamond | F41C 27/00 42/90 |
| 2016/0211095 | A1* | 7/2016 | Zimmer | H01H 9/0235 |

* cited by examiner

TAPE SWITCH MOUNTING BRACKET FOR FIREARM

CROSS REFERENCES TO RELATED APPLICATIONS none.

STATEMENT AS TO RIGHTS OF INVENTIONS MADE UNDER FEDERALLY SPONSORED RESEARCH DEVELOPMENT

Not Applicable

BACKGROUND OF THE INVENTION

1. Field of the Invention

This invention relates to a tape switch mounting bracket for a firearm comprising of a one piece mounting bracket with at least two (2) parallel opposite first and second ends, switch slot, rail attachment feature, at least four (4) apertures, and whereby the switch slot has an indentation with at least one rounded rectangular third end and an overhang on said first and second ends and said third end and is adapted to receive a tape switch; whereby the rail attachment feature can be configured to fit a variety of rail mounting systems; whereby at least (2) apertures are adapted for receiving screws to attach said mounting bracket to said rail mounting system and whereby at least two apertures are adapted for receiving additional tape switch operated accessories.

2. Background Information

Many individuals use firearms with tape switch or pressure switch accessors. The use of these accessories requires that the tape switch to be attached to the firearm in some manner, and the use of tape switch attachments on firearms is known in the prior art.

Typically tape switches are attached to firearms by the use of adhesive backed hook and loop strips, wire, wire ties, or rubber bands. These means of attachment do not hold the tape switch in a secure or constant position and can easily be snagged on clothing or other obstructions and therefore allow the tape switch to move creating an inconsistent tape switch position issue for an end user. The end user requires the tape switch to remain in a constant fixed position. Further these means of attachment make moving the tape switch to a different location on the firearm or to a different firearm difficult or cumbersome. The prevent invention addresses these problems and disclose a tape switch mounting bracket which securely holds a tape switch in a constant position and allows the end user to remove or replace a damaged tape switch easily without removing the tape switch mounting bracket, and make moving the tape switch to a different position on the firearm simple. Thus, there is a need for a tape switch mounting bracket for a firearm.

As will be seen from the subsequent description, the preferred embodiments of the present invention overcome the problems and difficulties of the known prior art.

SUMMARY OF THE INVENTION

Many individuals use firearms with tape switch or pressure switch accessories such as lights which must be attached a firearm in some manner. The current means to attach tape switch accessories do not hold the tape switch in a secure or constant position. This is particularly important for end users using a tape switch light accessory in a low-light or dark environment. Further these current means of attachment make moving the tape switch to a different location on the firearm or to a different firearm difficult.

The present invention relates to tape switch mounting bracket for use with a firearm comprising of a one-piece mounting bracket with at least two (2) parallel opposite first and second ends, switch slot, rail attachment feature, at least four (4) apertures, and whereby the switch slot is adapted to receive a tape switch; and whereby the rail attachment feature is adapted to mount to a variety of rail mounting systems. The preferred embodiment includes a tape switch mounting bracket with a switch slot comprising of an indention with at least one rounded rectangular third end and an overhang on said first and second ends and said third end; the section beneath or at an adjacent angle to the switch slot comprises of a rail attachment feature to mount the tape switch bracket to a variety of rail mounting systems. These mounting features included specific shapes and dimensions as required by their original designers to attach various types of equipment and brackets to the mounting rail. One type of mounting system is MIL-STD 1913 or Picatinny accessory mounting rail for small arms. A second type mounting system is KeyMod developed by VLTOR Weapon Systems of Tucson, Ariz., and yet a third type of mounting system is M-Lok developed by Magpul Industries. Each rail mounting system has its own unique fastening methods and requires some standard and some specialized fasteners to hold the tape switch bracket secure to the rail mounting system. These three mounting rail systems are noted as the three most prevalent rail mounting systems in the firearm industry. The art work in the patent shows the tape switch bracket attached to these three rail mounting systems but is not intended to account for all rail mounting systems in the firearm industry. Moreover the patent intent is to provide a secure method of mounting a tape switch.

DESCRIPTION OF THE PREFERRED EMBODIMENTS

In accordance with the present invention, a tape switch mounting bracket for firearm is disclosed.

Figure 1:
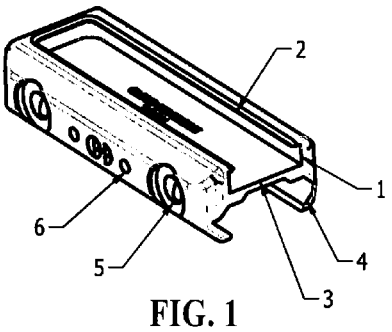
FIG. 1 illustrates a tape switch mounting bracket for use with a firearm comprising of a one-piece mounting bracket with at least two (2) parallel opposite first and second ends, switch slot, rail attachment feature, at least four (4) apertures, and whereby the switch slot is adapted to receive a tape switch; and whereby the rail attachment feature is adapted to mount to a variety of rail mounting systems. It further illustrates the preferred embodiment of a tape switch mounting bracket with a switch slot comprising of an indention with at least one rounded rectangular third end and an overhang on said first and second ends and said third end; the section beneath or at an adjacent angle to the switch slot comprises of a rail attachment feature to mount the tape switch bracket to a variety of rail mounting systems.
Figure 2:
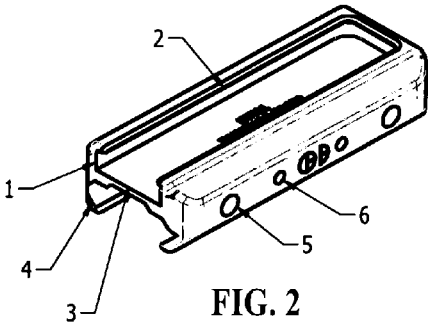
FIG. 2 also illustrates the tape switch mounting bracket for use with a firearm and its preferred embodiments.
Figure 3:
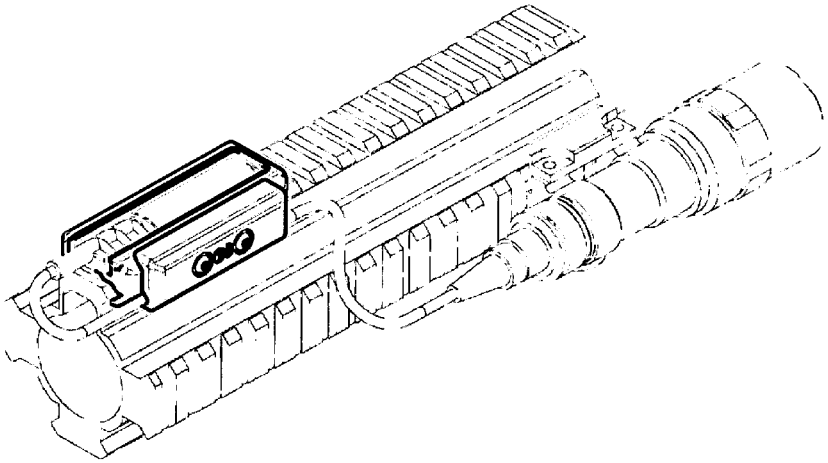
FIG. 3 illustrates the tape switch mounting bracket attached to a MIL-STD 1913 or Picatinny accessory mounting rail for small arms with a tape switch and tape switch accessory inserted into the tape switch mounting bracket.
Figure 4:
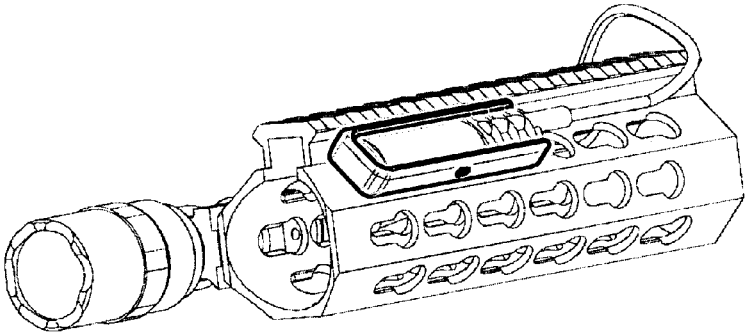
FIG. 4 illustrates the tape switch mounting bracket attached to a KeyMod accessory mounting rail for small arms with a tape switch and tape switch accessory inserted into the tape switch mounting bracket.
Figure 5:
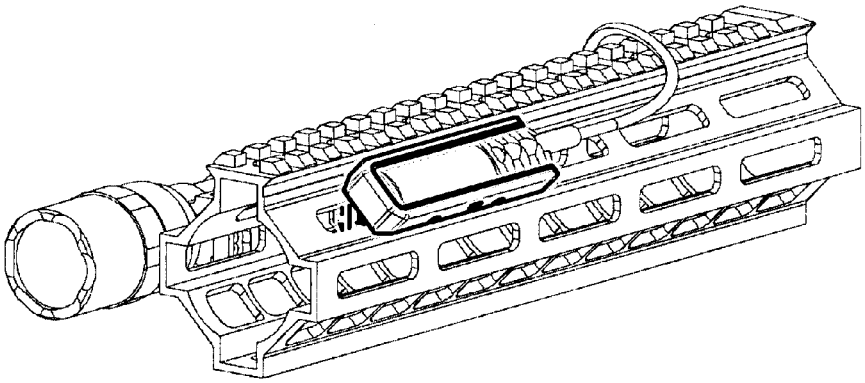
FIG. 5 illustrates the tape switch mounting bracket attached to a M-Lok accessory mounting rail for small arms with a tape switch and tape switch accessory inserted into the tape switch mounting bracket.

FIGS. 1 and 2 illustrate the preferred embodiment of the tape switch mounting bracket for a firearm. The apparatus generally includes a one-piece mounting bracket with at least two (2) parallel opposite first and second ends, switch slot, rail attachment feature, at least four (4) apertures, and whereby the switch slot is adapted to receive a tape switch; and whereby the rail attachment feature is adapted to mount to a variety of rail mounting systems. The apparatus allows an end user to insert a tape switch into the switch slot and attach the tape switch mounting bracket securely to a variety of rail mounting system on a firearm as shown in FIGS. 3, 4, and 5.

As shown in FIGS. 1 and 2, the switch slot consists of an indention on the top of the tape switch mounting bracket between the first and second opposite ends and with at least one rounded rectangular third end. An overhang on said first and second ends and said third end allows for the switch slot to hold the tape switch securely and prevents the tape switch from moving laterally in three directions. The switch slot can be sized to hold a specific manufacture's tape switch with friction to prevent movement in the fourth lateral direction towards the open end. Further the overhang of the switch slot retains the tape switch inside the switch slot and prevents upward travel. The preferred overhang profile is slim so as not to impeded operation of the tape switch which is activated by tactile contact with a finger or thumb. The bottom or base of the switch slot provides a foundation support for the tape switch and allows for separation between the tape switch and the rail mounting system surface. The distance between the bottom of the switch slot and the underside of the overhang are sized to hold the specific manufacture's tape switch with friction to prevent movement.

FIGS. 1 and 2 show the rail attachment feature which is beneath or at an adjacent angel to the switch slot, whereby the rail attachment feature consists of an indention on the bottom of the tape switch mounting bracket. The rail attachment feature can be configured to fit a variety of rail systems including the Picatinny or MIL-STD 1913 Accessory Mounting rail for small arms, KeyMOD or M-Lok rails.

The tape switch mounting bracket as shown in FIGS. 1 and 2 additionally consists of at least (2) apertures for attachment to the rail mounting bracketing system and at least two (2) apertures for attachment of accessories. Each rail mounting system has its own unique fastening methods and requires some standard and some specialized fasteners to hold the tape switch bracket secure to the rail mounting system. The tape switch mounting bracket is able to be configured to account for the various rail mounting systems. FIGS. 3, 4 and 5 show the tape switch mounting bracket on the three most prevalent rail mounting systems in the firearm industry. These figures are not intended to account for all rail mounting systems in the firearm industry. Moreover the patent intent is to provide a secure method of mounting a tape switch.

As shown in FIGS. 1 and 2, the tape switch mounting bracket is a preferred 2.5 inches in total length and is preferred to be made of military grade aluminum due to its durability, light weight and response to anodized coatings which increase the brackets durability and add corrosion resistance, and can make the bracket non-reflective. Further the tape switch mounting bracket can position the tape switch at a 45 degree angle to the rail systems via brackets made with a 45 degree offsets in either right-hand or left-hand versions depending on the end user's preference.

The preferred embodiments as described herein allow the entire apparatus to be securely held in a constant position on the rail system for the end user which resolve the issue of movement seen with other means of attachment for tape switches. Additionally, the preferred embodiments of the entire apparatus allow the tape switch to be held securely in a constant position through the use of friction and when needed allows the end user to simply and easily remove the tape switch without the removing the tape switch mounting bracket from the firearm.

Although the description above contains many specifications, these should not be construed as limiting the scope of the invention but as merely providing illustrations of some of the presently preferred embodiments of this invention.

The invention claimed is:

1. A tape switch mounting bracket for a firearm, comprising:

a mounting bracket having a first side wall that defines a first inner surface and a parallel second side wall that defines a second inner surface and an end wall that defines an end wall inner surface, a switch slot, and a rail attachment, wherein said first and second side walls and said end wall define a height;

and wherein the switch slot is disposed on an exposed top side of said mounting bracket and wherein said first and second inner surfaces, said end wall inner surface and a bottom surface define a channel within said switch slot, and an opening opposite said end wall inner surface is in communication with said channel, and wherein said opening and said channel sized and shaped for sliding receipt of a tape switch; and the rail attachment is adapted for releasably attaching to a rail mounting system for said firearm;

and wherein said first side wall includes a first aperture that is aligned with a first aperture in said second side wall, and said first aligned apertures are adapted for receiving a fastener to tighten said mounting bracket to said rail mounting system, and wherein said mounting bracket defines a length and said switch slot extends said length.

2. The apparatus of claim 1, wherein said end wall having a rounded rectangular shape.

3. The apparatus of claim 2, wherein an upper edge is disposed along an upper most end of said first and second side walls and said end wall.

4. The apparatus of claim 3, wherein said upper edge includes a lip that extends over said channel that is in frictional contact with the tape switch.

5. The apparatus of claim 4, wherein said lip is perpendicular to said height.

6. The apparatus of claim 1, wherein said rail attachment comprising an indention disposed on a bottom side of said mounting bracket between the first and second side walls.

7. The apparatus of claim 1, wherein said mounting bracket is a one-piece bracket constructed of a light weight metal material.

8. The apparatus of claim 1, wherein said first side wall includes a second aperture that is aligned with a second aperture in said second side wall.

9. A mounting bracket for a firearm, comprising:

a bracket member having first and second side walls, an end wall, and an opening opposite said end wall, a switch slot disposed on an exposed top side of said bracket member, and a rail slot disposed on a bottom side of said bracket member, and wherein said first and second side walls and said end wall define a height, and said bracket member defines a length;

and wherein said switch slot having parallel first and second sides and a bottom surface that define a channel, and wherein said first and second sides and said bottom surface extend said length;

wherein said first side wall includes a first aperture that is aligned with a first aperture in said second side wall, and said first aligned apertures are adapted for receiving a fastener to releasably tighten said mounting bracket to said rail mounting system, and wherein an upper most end of said first and second side walls include an upper edge having a lip that extends over said channel.

10. The apparatus of claim 9, wherein said end wall having a rounded rectangular shape.

11. The apparatus of claim 9, wherein said mounting bracket is a one-piece bracket constructed of a light weight metal material.

12. The apparatus of claim 9, wherein said lip is perpendicular to said height.

13. The apparatus of claim 9, wherein said first side wall includes a second aperture aligned with a second aperture in said second side wall.

14. A mounting bracket for a firearm, comprising:

a one-piece bracket having first and second side walls, an end wall, a switch slot disposed on an exposed upper side of said bracket, an opening on said upper side opposite said end wall, and a rail slot disposed on a bottom side of said bracket, and wherein said one-piece bracket defines a length; wherein said first and second side walls, said end wall and a bottom surface define said switch slot, and wherein said switch slot extends said length; an upper edge is disposed along an upper most end of said first and second side walls and said end wall, and said upper edge on said first and second side walls extend said length, and wherein said upper edge includes a lip that extends over said switch slot.

15. The apparatus of claim 14, wherein said first side wall includes a first aperture that is aligned with a first aperture in said second side wall, and said first aligned apertures are adapted for receiving a fastener to releasably tighten said bracket to said rail mounting system.

16. The apparatus of claim 15, wherein said first side wall includes a second aperture aligned with a second aperture in said second side wall.

17. The apparatus of claim 14, wherein said lip is perpendicular to said height.

* * * * *